United States Patent [19]

Takahashi et al.

[11] 3,992,590

[45] Nov. 16, 1976

[54] MATRIX AMPLIFYING CIRCUIT

[75] Inventors: Nobuaki Takahashi; Masaru Moriyama, both of Yamato, Japan

[73] Assignee: Victor Company of Japan, Ltd., Yokohama, Japan

[22] Filed: Apr. 9, 1975

[21] Appl. No.: 566,228

[30] Foreign Application Priority Data

Apr. 15, 1974 Japan ..... 49-40889

[52] U.S. Cl. ..... 179/15 BT; 179/100.4 ST; 179/1 GQ

[51] Int. Cl.[2] ..... H04R 5/00; H04H 5/00

[58] Field of Search ..... 179/15 BT, 1 GQ, 1 G, 179/100.1 TD, 100.4 ST; 330/69

[56] References Cited

UNITED STATES PATENTS

| | | | |
|---|---|---|---|
| 3,076,057 | 1/1963 | Baugh | 179/15 BT |
| 3,629,719 | 12/1971 | Heller | 330/69 |
| 3,746,792 | 7/1973 | Scheiber | 179/1 GQ |
| 3,757,241 | 9/1973 | Kime et al. | 330/69 |

*Primary Examiner*—Douglas W. Olms

[57] ABSTRACT

A matrix amplifying circuit comprises a first operational amplifier having an inverting and a non-inverting input terminal. The sum of the first and second channel signals is applied to the inverting terminal. The difference of the two channel signals is applied to the non-inverting terminal. The matrix amplifier substracts these sum and difference signals and a second operational amplifier adds them. This second amplifier has an inverting input terminal to which the sum signal and the difference signal are respectively supplied. These first and second operational amplifiers respectively produce first and second channel signals, as outputs thereof.

3 Claims, 2 Drawing Figures

MATRIX AMPLIFYING CIRCUIT

BACKGROUND OF THE INVENTION

This invention relates generally to matrix amplifying circuits and more particularly to a matrix amplifying circuit which is especially adapted for matrixing a sum signal and a difference signal taken from a multichannel record disc reproducing system and for thereby obtaining separate channel signals.

A discrete 4-channel record disc has been previously described in a granted U.S. Pat. No. 3,686,741. Two sum signals and two difference signals are obtained by a matrix circuit used in the recording system. A direct wave sum signal and an angle-modulated wave (obtained by angle modulating a carrier wave of 30 KHz with a difference signal) are recorded in a superimposed state on each wall of a disc sound groove. In the reproducing system, a pickup cartridge reproduces the direct wave sum signal and the angle-modulated wave difference signal which are thereafter separated from the superimposed signals. The angle-modulated wave difference signal is demodulated. The above mentioned sum signal and difference are matrix by a matrix circuit and then led out separately as the signals of the different channels.

In one known matrix circuit, used in a multichannel record disc reproducing system as described above, the difference signal of the first and second channels is fed to the base of a transistor. The sum signal of the first and second channels is added to a difference signal of opposite phase, by way of a plurality of suitable resistors, respectively. The opposite phase signals are derived from the collector of the transistor by way of a first capacitor. A difference signal of the same phase is derived from the emitter of the transistor, by way of a second capacitor. First and second channel signals are respectively obtained separately. The same circuit is used also for obtaining the third and fourth channels.

In this known matrix circuit, in actual practice, however, there are differences in the output impedances of the emitter and collector of the transistor. Furthermore, there are errors in the resistance values between the various resistors. For this reason, there are differences in the gains for the difference and the sum signals, as measured between the input side and the output side, for the signals of the different channels. Consequently, accurate addition and subtraction operations cannot be carried out, and deviations occur between individual output channel signals.

Furthermore, as a result of the first and second capacitors for interstage coupling, a phase shift occurs in the low-frequency band of the signal. It is difficult to carry out accurate addition and subtraction operations.

SUMMARY OF THE INVENTION

It is a general object of the present invention to provide a novel and useful matrix amplifying circuit in which the above described difficulties have been overcome.

Another and specific object of the invention is to provide a matrix amplifying circuit, by which original signals of two channels can be separately derived, with good balance between sum and difference signals of two channels.

In keeping with an aspect of the invention, these and other objects are provided by a matrix amplifying circuit comprising a first operational amplifier for receiving a first signal applied through an inverting input terminal and a second signal applied through a non-inverting input terminal, and thereupon subtracting the two signals. A second operational amplifier receives the first and second signals through an inverting input terminal, for adding the two signals. By this feature, the matrix amplifying circuit of the present invention provides the gains of the operational amplifiers, which gain is determined by the ratios of the resistance values. For this reason, even if there are deviations in the values of the resistances, the ratios of the various resistance values are maintained constant. Accordingly, if the circuit is an integrated circuit, even on a mass production scale, balanced matrix amplifiers can be obtained. Furthermore, since coupling capacitors are not used, phase shifting and similar undesirable effects do not occur, even in a low-frequency band.

Further objects and features of the invention will be apparent from the following detailed description with respect to preferred embodiments of the invention, when read in conjunction with the accompanying drawing.

DETAILED DESCRIPTION

Figure 1:
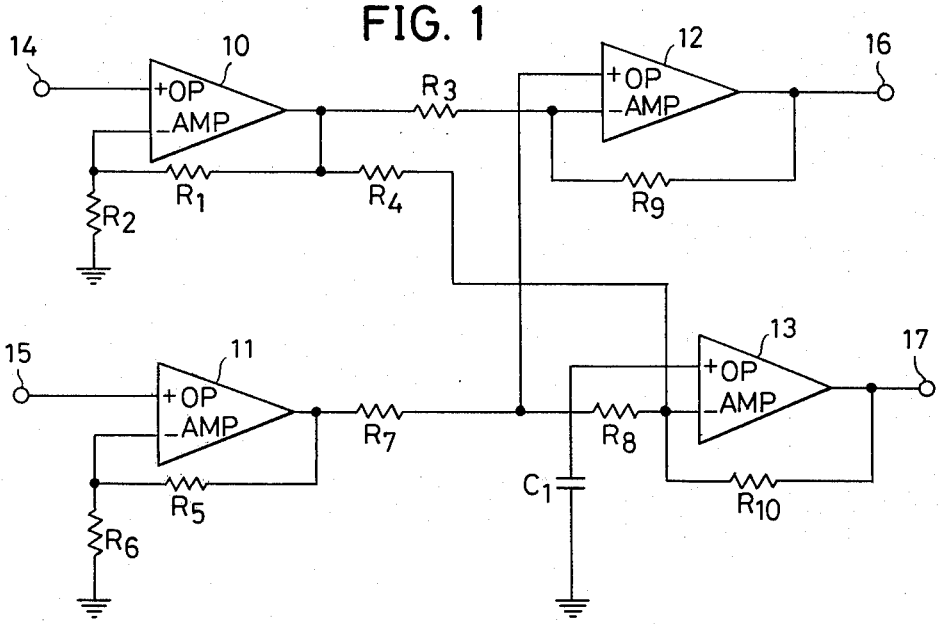
FIG. 1 is a circuit diagram showing a first embodiment of a matrix amplifying circuit, according to the invention.

FIG. 1 illustrates one embodiment of matrix amplifying circuit according to the present invention. A sum of first and second channel signals is applied to an input terminal 14 of the circuit, and thence supplied to a non-inverting input terminal of an operational amplifier 10. Here, the sum signal is amplified with an amplification factor (R1 + R2)/R2, as determined by a feedback resistor R1 and a grounding resistor R2. The output signal of this operational amplifier 10 is supplied by way of a resistor R3 to an inverting input terminal of an operational amplifier 12. It is amplified with an amplification factor R9/R3, which is determined by the resistor R3 and a feedback resistor R9. Furthermore, the output signal of the operational amplifier 10 is supplied by way of a resistor R4 to an inverting input terminal of an operational amplifier 13, where it is amplified with an amplification factor R10/R4 determined by the resistor R4 and a feedback resistor R10.

On the other hand, a difference signal of the first and second channel signal is applied to an input terminal 15 and is supplied to a non-inverting input terminal of an operational amplifier 11. There, it is amplified with an amplification factor (R5 + R6)/R6, as determined by a feedback resistor R5 and a grounding resistor R6. The output signal of this operational amplifier 11 is applied by way of a resistor R7 to a non-inverting input terminal of the operational amplifier 12 and is amplified with an amplification factor $$\frac{R8}{R7 + R8} \times \frac{R3 + R9}{R3}$$

determined by resistors R3, R9, R7, and R8. Furthermore, the output signal of the operational amplifier 11 is supplied by way of the resistors R7 and R8 to the inverting input terminal of the operational amplifier 13. There, it is amplified with an amplification factor R10/(R7 + R8) determined by the resistors R7, R8, and R10. The non-inverting input terminal of the operational amplifier 13 is grounded through a capacitor C1.

The operational amplifier 12, subtracts the sum signal and difference signal. The signal of the first channel is led out through an output terminal 16. Furthermore, the operational amplifier 13 adds the sum signal and difference signal. The signal of the second channel is led out of an output terminal 17.

Here, it will be assumed that the input impedances of the operational amplifiers 10, 11, 12, and 13 are respectively infinity, as an approximation; that the output impedances thereof are respectively zero; and that the open loop gains thereof are respectively infinity.

The various amplification factors set forth above may be compiled as follows. The gain G1 between the sum signal input terminal 14 and the output terminal 16 is $$G1 = \frac{R1 + R2}{R2} \times \frac{R9}{R3};$$

the gain G2 between the sum signal input terminal 14 and the output terminal 17 is $$G2 = \frac{R1 + R2}{R2} \times \frac{R10}{R4};$$

the gain G3 between the difference signal input terminal 15 and the output terminal 16 is $$G3 = \frac{R5 + R6}{R6} \times \frac{R8}{R7 + R8} \times \frac{R3 + R9}{R3};$$

the gain G4 between the difference signal input terminal 15 and the output terminal 17 is $$G4 = \frac{R5 + R6}{R6} \times \frac{R10}{R7 + R8}.$$

Then, when the values of the various resistances are so set that $$\frac{R9}{R3} = \frac{R10}{R4}$$

and $$\frac{R8(R3 + R9)}{R3} = R10,$$

and the following relations are obtained $$G1 = G2$$

and $$G3 = G4$$

That is, the gain between the input terminal 14 and the output terminal 16, and the gain between the input terminal 14 and the output terminal 17 become equal. The gain between the input terminal 15 and the output terminal 16, and the gain between the input terminal 15 and the output terminal 17 also become equal.

Accordingly, by selecting the resistance values of the resistors R3, R4, R8, R9, and R10, as described above, the sum signal and difference signal are, respectively, amplified with the same gain.

The above described operational amplifiers 10 through 13 and resistors R1 through R10 can be constructed in the form of an integrated circuit. In this case, even if the deviation of the resistance values is very large, for example, of the order of ± 20 percent, the deviation in the ratios of the resistance values can be held to approximately ± 2 percent. These ratios can be maintained substantially constant. Accordingly, matrix amplifiers of uniform and balanced characteristic can be produced by mass production.

Furthermore, since the above described operational amplifiers are connected directly and not through respective coupling capacitors, there is no phase shift even in a low-frequency band. Addition and subtraction operations can be accomplished accurately on sum signals and difference signals.

Therefore, well-balanced first and second channel signals can be obtained through the output terminals 16 and 17.

Next, a second embodiment of the matrix amplifier circuit according to this invention will be described with reference to FIG. 2. Parts in FIG. 2 which are the same as or equivalent to corresponding parts in FIG. 1 are designated by like reference numerals and characters. A detailed description of these parts will not be repeated.

Figure 2:
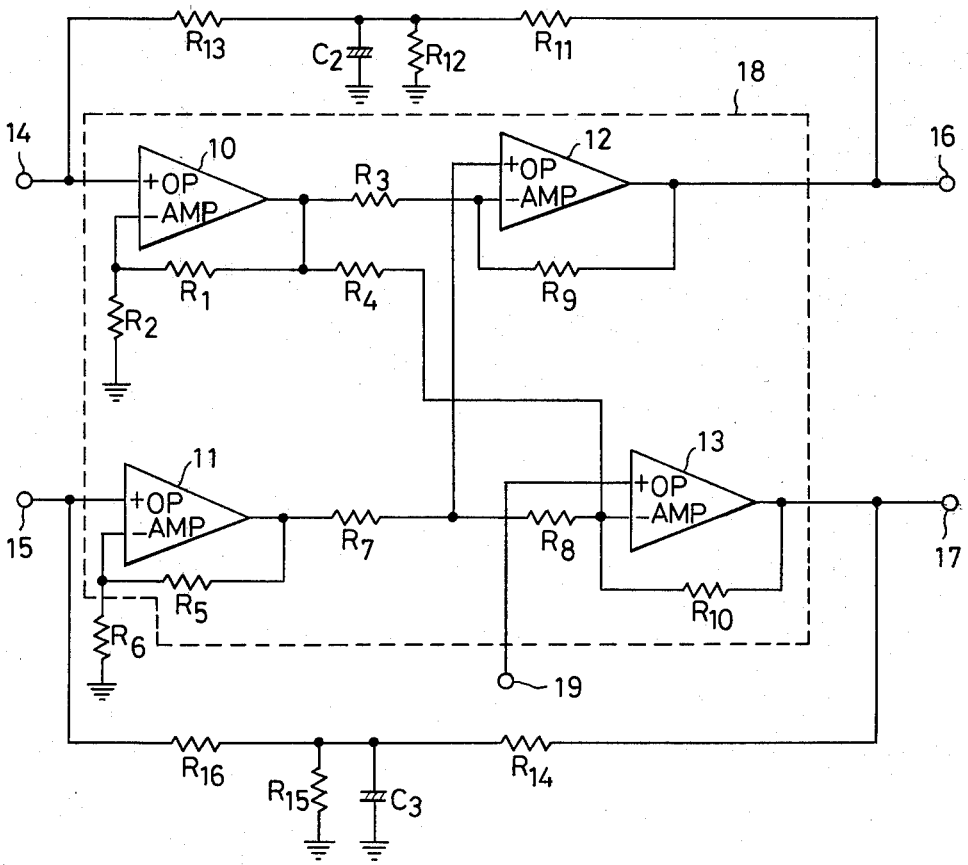
FIG. 2 is a circuit diagram showing a second embodiment of a matrix amplifying circuit, according to the invention.

FIG. 2, the circuit 18, enclosed by a dashed or intermittent line, has an organization substantially the same as that of the circuit illustrated in FIG. 1, and it is constructed in the form of an integrated circuit. With respect to this integrated circuit 18, resistors R11, R12, and R13 and a capacitor C2 of large capacitance value are externally connected between the terminals 16 and 14. Resistors R14, R15, and R16 and a capacitor C3 of large capacitance value are externally connected between the terminals 17 and 15. A bias voltage is impressed on a terminal 19 connected to the non-inverting terminal of the operational amplifier 13.

As described above in conjunction with the circuit of the first embodiment, a sum signal is supplied to the input terminal 14. After being amplified with the same phase by the operational amplifier 10, the sum signal is phase inverted and amplified by the operational amplifiers 12 and 13, respectively. On the other hand, a difference signal is supplied to the input terminal 15, after being and amplified with the same phase by the operational amplifier 11. Then it is amplified, respectively, by the operational amplifier 12 with the same phase and by the operational amplifier 13 with an inverted phase. As a result, well-balanced first and second channel signals are separately obtained, respectively, from the output terminals 16 and 17.

On the other hand, the output signal of the operational amplifier 12 is smoothed by the resistors R11 and R12 and the capacitor C2. The output signal is then fed back with a large DC voltage, gain by way of the resistor R13, to the non-inverting input terminal of the operational amplifier 10. For this reason, the operational amplifier 10 is biased and operates at an appropriate operational point. The sum signal is amplified in a stable manner.

The output signal of the operational amplifier 13 is smoothed by the resistors R14 and R15 and the capacitor C3, and then is fed back with a DC voltage gain which is greater than the AC gain, by way of the resistor R16 to the non-inverting input of the operational amplifier 11. For this reason, the operational amplifier 11 is also biased and operates at an appropriate operational point. The difference signal is amplified in a stable manner.

The sum signal input terminal 14 and the difference signal terminal 15 are connected, respectively, to the non-inverting input terminals of the operational amplifiers 10 and 11. In general, the input impedance of a non-inverting input terminal of an operational amplifer is higher than that of an inverting input terminal. For this reason, good negative feedback is accomplished. Furthermore, since the quantity of feedback of audio signals is small, by the use of capacitors C2 and C3 of large capacitance value, a large DC negative feedback is attained.

The constants of the various circuit elements of the circuit illustrated in FIG. 2 are as follows.

| | | | |
|---|---|---|---|
| Resistors | | | |
| R1 | 5 KΩ | R2 | 525 Ω |
| R3 | 5 KΩ | R4 | 5 KΩ |
| R5 | 22 KΩ | R6 | 3.9 KΩ |
| R7 | 2.34 KΩ | R8 | 2.66 KΩ |
| R9 | 5.64 KΩ | R10 | 5.64 KΩ |
| R11 | 56 KΩ | R12 | 15 KΩ |
| R13 | 56 KΩ | R14 | 56 KΩ |
| R15 | 22 KΩ | R16 | 56 KΩ |
| Capacitors | | | |
| C2 | 10 μF | C3 | 10 μF |

Further, this invention is not limited to these embodiments but various variations and modifications may be made without departing from the scope and spirit of the invention.

What is claimed is:

1. A matrix amplifying circuit comprising:

first operational amplifier means including a feedback resistor connected between the output terminal and an inverting input terminal thereof;

second operational amplifier means including a feedback resistor connected between the output terminal and an inverting input terminal thereof;

third operational amplifier means including a feedback resistor having a resistance value R9 which is connected between the output terminal and an inverting input terminal thereof;

fourth operational amplifier means including a feedback resistor having a resistance value R10 which is connected between the output terminal and an inverting input terminal thereof;

a first resistor connected between the inverting input terminal of said first amplifier means and ground;

a second resistor having a resistance value R3 which is connected between the output terminal of said first amplifier means and the inverting input terminal of said third amplifier means;

a third resistor having a resistance value R4 which is connected between the output terminal of said first amplifier means and in the inverting input terminal of said fourth amplifier means;

a fourth resistor connected between the inverting input terminal of said second amplifier means and ground;

a series combination of two resistors respectively having resistance values R7 and R8 which is connected between the output terminal of said second amplifier means and the inverting input terminal of said fourth amplifier means;

the resistance values R3, R4, R8, R9 and R10 satisfying the following equations:

$$\frac{R9}{R3} = \frac{R10}{R4}$$

and $$R10 = \frac{R8(R3 + R9)}{R3};$$

means for electrically and directly connecting the junction of the two resistors in said series combination to a non-inverting input terminal of said third amplifier means;

means for applying a sum signal comprised of first and second channel signals to a non-inverting input terminal of said first amplifier means; and means for applying a difference signal comprised of the first and second channel signals to a non-inverting input terminal of said second amplifier means to deliver the first channel signal from the output terminal of said third amplifier means and the second channel signal from the output terminal of said fourth amplifier means.

2. A matrix amplifying circuit as claimed in claim 1 further comprising:

first negative feedback circuit means including smoothing means for smoothing the output signal of said third amplifier means, said first negative feedback circuit means being connected between the output terminal of said third amplifier means and the non-inverting input terminal of said first amplifier means; and second negative feedback circuit means including smoothing means for smoothing the output signal of said fourth amplifier means, said second negative feedback circuit means being connected between the output terminal of said fourth amplifier means and the non-inverting input terminal of said second amplifier means.

3. A matrix amplifying circuit as claimed in claim 2 further comprising means for applying a bias voltage to a non-inverting input terminal of said fourth amplifier means; and in which said first negative feedback circuit means comprises a first series circuit of two resistors which is connected between the output terminal of said third amplifier means and the non-inverting input terminal of said first amplifier means, and a parallel circuit of a resistor and a capacitor which is connected between the junction of the two resistors and ground; and said second negative feedback circuit means comprises a second series circuit of two resistors which is connected between the output terminal of said fourth amplifier means and the non-inverting input terminal of said second amplifier means, and a parallel circuit of a resistor and a capacitor which is connected between the junction of the two resistors of said second series circuit and ground.

* * * * *